United States Patent [19]

Hutchinson

[11] 4,396,345

[45] Aug. 2, 1983

[54] UNLOADER VALVE HAVING BYPASS VALVING MEANS

[75] Inventor: William R. Hutchinson, Winston-Salem, N.C.

[73] Assignee: Ingersoll-Rand Company, Woodcliff Lake, N.J.

[21] Appl. No.: 261,731

[22] Filed: May 7, 1981

[51] Int. Cl.[3] ..... F01B 25/00

[52] U.S. Cl. ..... 415/28; 415/29

[58] Field of Search ..... 415/26, 28, 29; 137/112, 606, 607

[56] References Cited

U.S. PATENT DOCUMENTS

| | | | |
|---|---|---|---|
| 1,421,308 | 6/1922 | Redfield | 137/112 X |
| 1,925,610 | 9/1933 | Shinn | 137/112 |
| 2,323,927 | 7/1943 | Mercier | 137/606 X |
| 2,374,822 | 5/1945 | LeClair | 137/112 X |
| 2,705,501 | 4/1955 | Fritzsch | 137/112 |
| 2,722,946 | 11/1955 | Mueller | 137/606 X |
| 2,876,788 | 3/1959 | Shube | 137/112 |
| 3,180,088 | 4/1965 | Swain | 415/28 X |
| 3,439,579 | 4/1969 | Guinot | 137/112 X |

FOREIGN PATENT DOCUMENTS

| | | | |
|---|---|---|---|
| 227849 | 3/1967 | U.S.S.R. | 137/112 |
| 675256 | 7/1979 | U.S.S.R. | 415/26 |

*Primary Examiner*—Philip R. Coe
*Assistant Examiner*—Frankie L. Stinson
*Attorney, Agent, or Firm*—B. J. Murphy

[57] ABSTRACT

The invention comprises incorporating in the wall of a typical unloader valve for a compressor, a normally-closed, pressure-responsive valve for admitting product compressed air therethrough, into the valve chamber, for re-circulation of the admitted air through the compressor. In the first embodiment illustrated, a pilot air pressure, which modulates the unloader valve throttling piston, is also addressed to a passageway which opens onto the normally-closed valve. When the pilot air pressure is substantially elevated, the normally-closed valve opens.

5 Claims, 2 Drawing Figures

UNLOADER VALVE HAVING BYPASS VALVING MEANS

Figure 1:
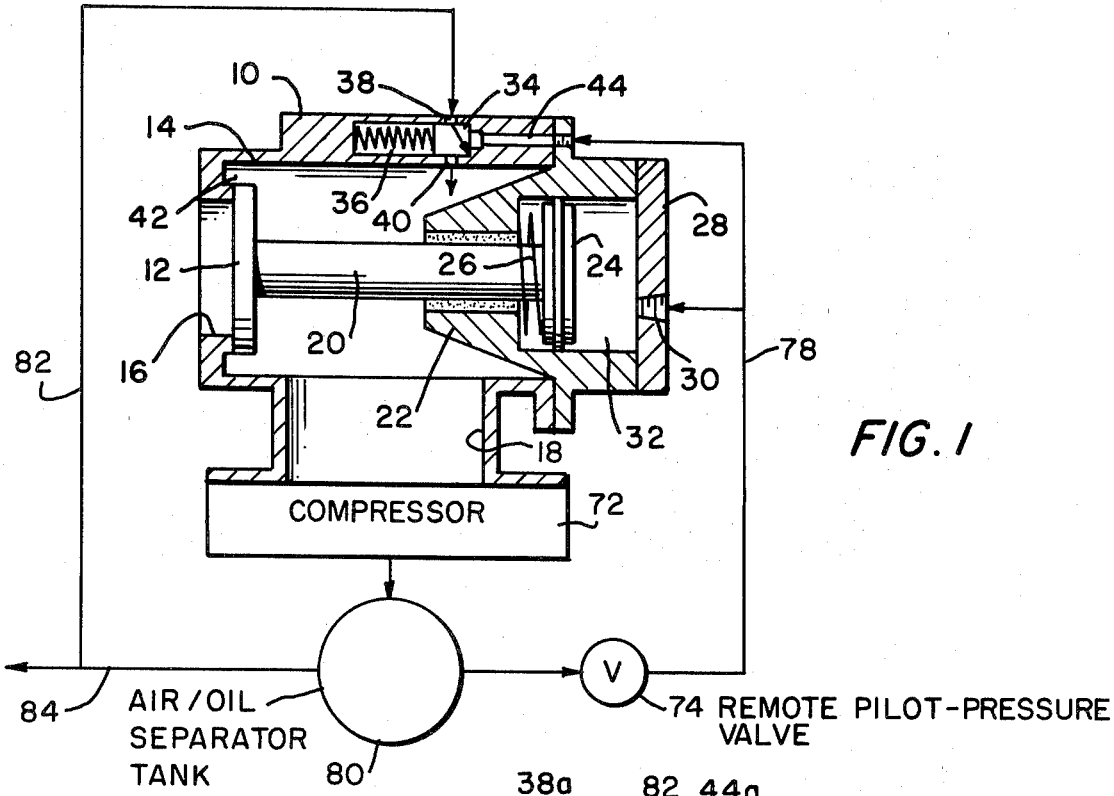

This invetion pertains to air compressors and, in particular, to inlet valve means for such compressors having throttling devices for unloading the compressor when the demand for the product compressed air is diminished, such valve means being commonly known as unloader valves.

In fluid-working machines, particularly in rotary, screw, air compressors, having one rotor transmitting power to the other, destructive vibration and noise can be generated when the compressor inlet unloader valve is throttled to reduce the air flow entering the compressor to zero. Throttling must be done, of course, to prevent excessive discharge pressure when no compressed air is required to be delivered from the compressor. The vibration and noise (hereafter referred to as "rumble") can be eliminated if a proper amount of air is allowed to pass through the rotors all the while the compressor is unloaded. One method of doing this is to allow discharge air from the compressor to recirculate back through the rotors when the inlet unloader valve is closed (compressor unloaded). Some sort of normally-closed valve is usually employed to do this, but it is costly to mount and connect the valve and the necessary piping and/or conduits therefor.

The invention has, as its object, an improvement over the prior art practices for recirculating air through the machine (compressor), which obviates any need for extensive and costly piping and mountings.

It is an object of this invention, in particular, to set forth, for a fluid-working machine having (a) a structure with an aperture formed therein for admitting fluid into the machine, and (b) means for throttling the aperture, valve means for conducting fluid into said machine in shunting bypass of said throttling means, comprising a substantially hollow body for admitting fluid therethrough; said body having wall means for confining, therewithin, means for throttling conduct of fluid through said body; said wall means comprising a wall having a given passageway formed therethrough, with ports, opening internally and externally, respectively, of said wall, defining ends of said passageway; valving means, interfaced with at least one of said ports, operative, in response to predetermined fluid pressure addressed thereto, for opening and closing said one port to fluid conduct therethrough; and means for addressing fluid, at excursive pressures to said valving means.

It is also an object of this invention to set forth, in combination, a fluid-working machine having (a) a structure with an aperture formed therein for admitting fluid into the machine, and (b) means for throttling the aperture, valve means for conducting fluid into said machine in shunting bypass of said throttling means, wherein said structure comprises a substantially hollow body for admitting fluid therethrough into said machine; said body has wall means confining, therewithin, throttling means for throttling conduct of fluid through said body; and said wall means comprises a wall; wherein said valve means comprises a given passageway formed through said wall with ports, opening internally and externally, respectively, of said wall, defining ends of said passageway; valving means, interfaced with at least one of said ports, operative, in response to predetermined fluid pressures addressed thereto, for opening and closing said one port to fluid conduct therethrough; and means for addressing fluid, at excursive pressures, to said valving means.

Figure 2:
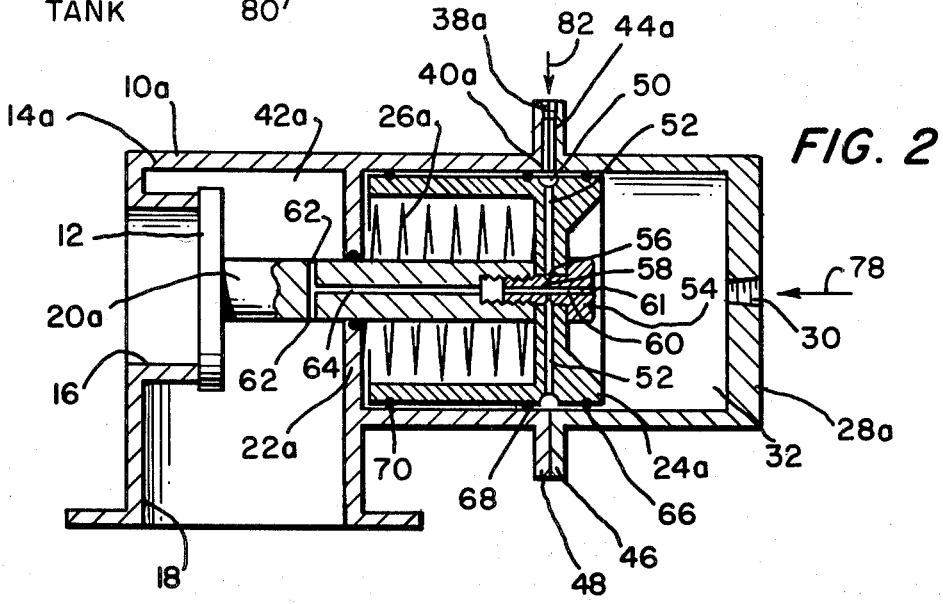

Further objects of this invention, as well as the novel features thereof, will become more apparent by reference to the following description taken in conjunction with the accompanying figures in which:

FIG. 1 is a longitudinal, cross-sectional view of a preferred embodiment of the invention; and FIG. 2 is a view like that of FIG. 1 showing an alternative embodiment of the invention.

The first embodiment of the invention is illustrated in FIG. 1. An unloader valve 10 comprises a throttling piston 12 operative within a cylinder 14. The throttling piston 12 opens, throttles, or closes an inlet port 16, in response to fluid and spring biasing forces, to regulate air flow to an inlet 18 of a compressor 72.

The throttling piston 12 is fixed to a rod 20 which is slidably supported in a guide 22. The end of the rod 20 opposite the throttling piston 12 has an actuating piston 24 fixed thereto. A compression spring 26 urges the actuating piston 24 toward the right (as viewed in FIG. 1); this spring action serves to open port 16 to communication with inlet 18.

Cylinder 14 has an end closure 28 with a port 30 formed therein. According to practices well known in the prior art, excursive fluid pressures, from a remote pilot valve 74 which monitors the pressure in the compressor receiver, or air-oil separator tank 76 are addressed, via a line 78 to port 30, and into a pilot-pressure chamber 32 in which the piston 24 is reciprocatably operative.

What has been described thus far is quite conventional for a throttling unloader valve 10 for a gas compressor. To accommodate for a bypass of the throtting piston 12, when the latter had closed off the inlet port 16, a pressure-responsive, normally-closed valve 34 is operatively disposed within a wall of the cylinder 14. The normally-closed valve 34 is set within a chamber 36 having ports 38 and 40 opening thereonto. The outermost port 38 communicates with the separator tank 80, via a line 82, and the innermost port 40 opens onto the unloader valve chamber 42. Line 82 is tapped off from a separator tank compressed air discharge line 84.

A passageway 44 has been formed through the wall to open into the chamber 36 in which the normally-closed valve 34 is disposed. The pilot pressure which is admitted to port 30, for modulation of the throttling piston 12, is also in communication with the passageway 44. Accordingly, when the pilot pressure becomes substantially elevated, substantially to close off the unloader valve 10, it also has moved the normally-closed valve 34 to its open position. Thus, product compressed air from the separator tank 80 may pass through the ports 38 and 40 into the unloader valve chamber 42, and thence to the compressor inlet 18. By this means, then, all the time that the compressor 72 is unloaded, a minor volume of the product compressed air is constantly recycled or recirculated through the unloader valve 10, in bypass of the inlet port 16 and piston 12, to inhibit rumble.

When the compressor 72 is in operation, running at full pressure, the pressure on the unloader actuating piston 24 and the normally-closed valve 34 is at or near zero. When less air is demanded from the compressor 72, pressure increases at the actuating piston 24 and in the passageway 44 which valve addresses the valve 34. At a given pressure, such that the unloader actuating piston 24 has pushed the throttling piston 12 to a nearly closed position, the pressure on the valve 34 is sufficient to open the latter and allow discharge (separator tank) air to enter the unloader valve chamber 42, behind the throttling piston 12, thus preventing rumble. A drop in pilot pressure allows the spring-biased valve 34 to close, as the unloader valve 10 opens.

The use of this invention provides the following advantages: (a) it eliminates rumble; (b) it reduces the cost of mounting a remote anti-rumble valve; (c) it reduces the amount of piping necessary to use an anti-rumble valve; (d) it reduces the space required to use an anti-rumble valve; and (e) it reduces the cost of an anti-rumble valve.

In the FIG. 1 embodiment, the compressor 72, separator tank 80, and remote pilot-pressure valve 74 are depicted only schematically.

FIG. 2 discloses an alternative embodiment 10*a* of the invention in which same or similar index numbers denote same or similar components as in the FIG. 1 embodiment. The schematic representations of the compressor 72, separator tank 80, and the remote pilot-pressure valve 74 are omitted; it should be understood, however, that they are also employed with the embodiment 10*a*. In this embodiment, it is not necessary to have a second valve, such as the normally-closed valve 34 used in the FIG. 1 embodiment. Instead, the actuating piston 24*a*, of alternative design, is put to a dual purpose. It is employed, as the piston which responds to the modulating pressure to position the throttling piston 12; also it serves the function of the normally-closed, pressure-responsive valve 34 of FIG. 1. The end closure 28*a* is fitted to the rest of the cylinder 14*a* by means of flanges 46 and 48. The interfacing surfaces, at a predetermined location on the flanges, are cast with radial, semi-circular troughs. According to this expedient, a passageway 44*a*, having terminal ports 38*a* and 40*a*, opens into the pilot-pressure chamber 32 in which the actuating piston 24*a* is disposed. The piston 24*a* has an annular groove 50 formed thereabout, and a pair of radial bores 52 communicating with the groove. A bolt 54, which secures the piston 24*a* to the piston rod 20*a*, also has an annular groove 56, radial bores 58, and an axially-extended bore 60. Bore 60 is closed, at the bolt-head end, by a plug 61. Radial ports 62 which communicate with an axial bore 64 in the rod 20*a* cooperate to define a passageway from port 38*a* into chamber 42*a*. O-ring seals 66, 68 and 70 are fitted about the actuating piston 24*a* in three locations.

When the pilot pressure substantially overcomes the bias of the spring 26*a* to move the throttling piston 12 to closure of the inlet port 16, the aforesaid ports, bores and grooves all come into common communication to allow commpressed gas product from the separator tank 80 to pass through the flanges 46 and 48, piston 24*a*, bolt 54, piston rod 20*a*, and into the unloader valve chamber.

While I have described my invention in connection with specific embodiments thereof, it is to be clearly understood that this is done only by way of example and not as a limitation to the scope of my invention as set forth in the objects thereof and in the appended claims.

I claim:

1. An unloader valve, for use in combination with (a) a fluid-working machine, such as an air compressor or the like, and (b) a supply of fluid at excursive pressures, said unloader valve having bypass valving means, comprising:

a substantially hollow body having at least a pair of spaced-apart openings formed therein;

a first of said openings defining porting means for admitting fluid into said body;

the other of said openings defining porting means for admitting fluid from said body into a fluid-working machine;

means within said body operative for throttling conduct of fluid from said first opening to said other opening;

said body having wall means for confining, therewithin, said throttling means;

said wall means comprising a wall having a given passageway, formed therethrough, with ports in which a first of said ports opens into said body for fluid communication thereof with said other opening in shunting bypass of said throttling means, and a second of said ports opens externally of said body for fluid communication thereof with a supply of fluid at excursive pressures;

said ports defining opposite ends of said passageway; and valving means, interfaced with at least one of said first and second ports, operative, in response to given, predetermined, pilot fuid pressures addressed thereto, for opening and closing said one port to fluid conduct therethrough; wherein said wall has a third port formed therein, which opens onto said valving means, for introducing therethrough and addressing to said valving means operative, pilot fluid pressures from a supply of fluid at excursive pressures.

2. An unloader valve, according to claim 1, wherein:

said wall has a chamber formed therewithin;

said first and second ports open into said chamber; and said valving means is disposed within said chamber.

3. An unloader valve, according to claim 2, further including:

a further passageway formed within said wall for communication with said chamber.

4. An unloader valve, according to claim 2, wherein:

said valving means comprises a normally-closed valve which, responsive to said given, pilot fluid pressures, addressed thereto, opens to accommodate fluid flow through said chamber between said ports.

5. An unloader valve, according to claim 1, wherein:

said valving means comprises a closure sealingly and slidably disposed in interface with said one port; and further including means coupled to said closure for supporting the latter in the aforesaid sealing and slidable disposition.

* * * * *

UNITED STATES PATENT AND TRADEMARK OFFICE

CERTIFICATE OF CORRECTION

PATENT NO. : 4,396,345

DATED : August 2, 1983

INVENTOR(S) : William R. Hutchinson

It is certified that error appears in the above—identified patent and that said Letters Patent is hereby corrected as shown below:

In column 4, line 31, "fuid" should read--fluid--.

Signed and Sealed this

*Twenty-fifth* Day of *October 1983*

[SEAL]

*Attest:*

GERALD J. MOSSINGHOFF

*Attesting Officer*

*Commissioner of Patents and Trademarks*